US005826793A

United States Patent [19]

Askew

[11] Patent Number: 5,826,793

[45] Date of Patent: Oct. 27, 1998

[54] TWO RATE FUEL INJECTOR

[75] Inventor: James Martin Anderton Askew, Gloucestershire, England

[73] Assignee: Lucas Industries, plc, England

[21] Appl. No.: 739,546

[22] Filed: Oct. 30, 1996

[51] Int. Cl.[6] ..... F02M 47/00

[52] U.S. Cl. ..... 239/124; 239/533.3; 239/533.8; 239/533.9

[58] Field of Search ..... 239/124, 533.2–533.5, 239/533.8, 533.9

[56] References Cited

U.S. PATENT DOCUMENTS

| | | | |
|---|---|---|---|
| 1,735,718 | 11/1929 | Attendu | 239/533.5 |
| 3,817,456 | 6/1974 | Schlappkohl et al. | 239/533.5 |
| 4,403,740 | 9/1983 | Eblen et al. | 239/533.8 X |
| 4,448,356 | 5/1984 | Nakajima et al. | 239/533.9 X |
| 4,566,635 | 1/1986 | Trachte | 239/533.8 |
| 4,640,252 | 2/1987 | Nakamura et al. | 123/446 |
| 5,441,028 | 8/1995 | Felhofer | 123/456 |
| 5,647,540 | 7/1997 | Buckley | 239/533.9 X |

FOREIGN PATENT DOCUMENTS

| | | |
|---|---|---|
| 1 433 513 | 4/1976 | United Kingdom . |
| 1 447 065 | 8/1976 | United Kingdom . |
| 2 093 117 | 2/1981 | United Kingdom . |
| 2 092 223 | 8/1992 | United Kingdom . |

*Primary Examiner*—Lesley D. Morris
*Attorney, Agent, or Firm*—Andrus, Sceales, Starke & Sawall

[57] ABSTRACT

An injector is described which comprises a valve element engageable with a seating, the valve element being resiliently biased into engagement with the seating. The valve element includes a thrust surface arranged, in use, to have high pressure fuel applied thereto to lift the valve element from the seating. A stop in the form of a second valve member is arranged to restrict movement of the valve element away from the seating, the second valve member being arranged to have high pressure fluid applied thereto and being movable under the influence of the valve element against the action of the high pressure fluid, in use.

8 Claims, 2 Drawing Sheets

TWO RATE FUEL INJECTOR

This invention relates to an injector for use in supplying high pressure fuel to a cylinder of an internal combustion engine. In particular, this invention relates to an injector which is arranged to inject fuel at a relatively low injection rate at the commencement of injection and to supply fuel at a higher rate at a subsequent point during injection. Such an injector will hereinafter be referred to as a two rate injector.

In a known two rate injector (for example see GB 1447065, GB 2093117, U.S. Pat. No. 4,566,635 or U.S. Pat. No. 4,640,252), a valve needle is biased by means of a helical spring into engagement with a valve seat. The valve needle includes one or more angled surfaces against which pressurized fuel can act to lift the valve needle away from the seat against the action of the spring. After a small amount of movement, the end of the valve needle remote from the seat engages a piston against which high pressure fuel acts. Such engagement restricts further movement of the valve needle until the pressure acting on the angled surfaces of the valve needle exceeds a predetermined value and is able to move both the valve needle and the piston.

In use, on supplying high pressure fuel to the angled surfaces of the valve needle, the needle is lifted from the seat by a small amount, thus fuel is supplied by the injector at a restricted, relatively low rate. The application of high pressure fuel to the angled surfaces whilst only a relatively small amount of fuel is injected results in the pressure of fuel acting on the angled surfaces increasing until a point is reached beyond which the pressure exerted on the angled surfaces is sufficient to overcome the pressure acting on the piston, whereby further movement of the valve needle is permitted. Such further movement results in a rise in the injection rate.

Two rate injectors are advantageous in that it has been found that engine noise can be reduced by providing a relatively low initial injection rate.

The two rate injector described hereinbefore has the disadvantage of being relatively complex, and it is an object of the invention to provide a two rate injector in which the disadvantages associated with known two rate injectors are reduced.

According to the present invention there is provided an injector comprising a valve element engageable with a seating, the valve element being resiliently biased into engagement with the seating, the valve element including a thrust surface arranged, in use, to have high pressure fuel applied thereto to lift the valve element from the seating, and stop means arranged to restrict movement of the valve element away from the seating, wherein the stop means comprises second valve means arranged to have high pressure fluid applied thereto, the second valve means being movable under the influence of the valve element against the action of the high pressure fluid, in use.

In use, such an arrangement permits the valve element to leave the seating by a small amount upon the initial application of high pressure fuel to the thrust surface, such movement being restricted by engagement of the valve element with the stop means. Further movement of the valve needle is then restricted until the pressure acting on the thrust surface is sufficiently high to open the second valve means against the action of the high pressure fluid.

The high pressure fluid is conveniently derived from a source separate from that arranged to supply high pressure fuel to the thrust surface. Such an arrangement permits improved control of the injector as the pressure of the high pressure fluid applied to the second valve means can be selected independently of the pressure of the fuel applied to the thrust surface.

Conveniently, on opening of the second valve means, high pressure fluid is applied to the valve element to assist subsequent movement of the valve element into engagement with the seating.

The invention will further be described, by way of example, with reference to the accompanying drawings, in which.

Figure 1:
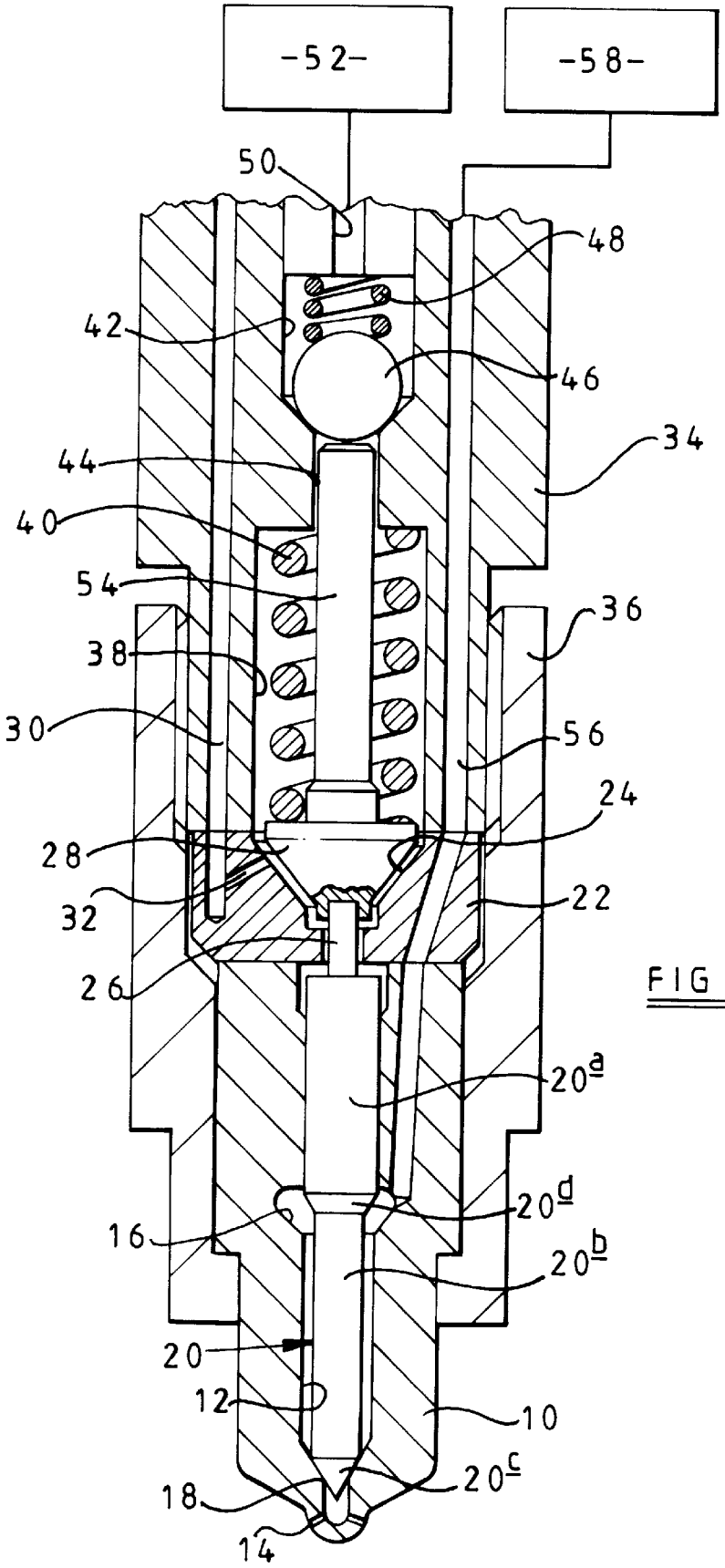
FIG. 1 is a cross-sectional view of part of an injector constituting an embodiment of the invention.

The two-rate injector illustrated in FIG. 1 comprises a nozzle body 10 in which a blind bore 12 is provided. Adjacent the blind end of the bore 12, a plurality of outlet apertures 14 are provided. The bore 12 is of substantially uniform diameter, an annular chamber 16 being provided approximately half way along the length of the bore 12, a region of the bore 12 adjacent the outlet apertures 14 being of reduced diameter and defining a valve seating 18.

A valve needle 20 is provided within the bore 12, the valve needle 20 including a first region 20*a* of diameter substantially equal to the diameter of the bore 12 so as to form a substantially fluid tight seal therewith, a reduced diameter region 20*b*, and a conical end region 20*c* which is engageable with the seating 18. A tapered region 20*d* interconnects the first and second regions 20*a*, 20*b*, and it will be seen from the drawing that the region 20*d* extends within the annular chamber 16. The end region 20*c* and region 20*d* are arranged such that the application of high pressure fuel thereto tends to lift the valve needle 20 from the seating 18, and will hereinafter be referred to as thrust surfaces.

The injector further comprises a distance piece 22 arranged to abut the end of the nozzle body 10 remote from the outlet apertures 14. The distance piece 22 includes a through bore 24 within which an extension 26 of the valve needle 20 extends with clearance. A spring abutment 28 is carried by the extension 26, the spring abutment 28 being of substantially conical shape, and extending within a similarly shaped enlarged region of the through bore 24. A drain passage 30 communicates with the enlarged region of the through bore 24 through a reduced diameter, and hence restricted, connecting passage 32.

The distance piece 22 abuts a nozzle holder 34 which is provided with a screw-threaded region which is in screw-threaded engagement with a cap nut 36, the cap nut 36 engaging the nozzle body 10 to secure the nozzle body 10 and distance piece 22 to the nozzle holder 34.

The nozzle holder 34 includes a spring chamber 38 within which a helical compression spring 40 is provided, the spring 40 engaging the spring abutment 28 thus urging the valve needle 20 towards the position illustrated in FIG. 1 in which the end region 20*c* engages the seating 18. The nozzle holder 34 further defines a valve chamber 42 communicating with the spring chamber 38 through a passage 44, the valve chamber 42 defining a seating against which a spherical valve element 46 is urged by means of a spring 48. The valve chamber 42 communicates through a passage 50 with a source 52 of high pressure fluid. An extension rod 54 extends from the spring abutment 28 through the spring chamber 38 and passes with clearance through the passage 44, the extension rod 54 terminating at a position spaced from the spherical valve element 46 when the valve needle 20 is in the position illustrated in FIG. 1.

The nozzle holder 34, distance piece 22 and nozzle body 10 are each provided with drillings which together define a fuel supply passage 56 for supplying fuel from a source of high pressure fuel 58 to the annular chamber 16.

In use, when it is desired to supply fuel from the outlet apertures 14, high pressure fuel is supplied from the source 58 through the supply passage 56 to the annular chamber 16 and the part of the bore 12 in which the reduced diameter part 20*b* of the valve needle 20 extends. The high pressure fuel acts against the angled thrust surface 20*d* and any exposed part of surface 20*c* of the valve needle 20 tending to lift the valve needle 20 away from the seating 18. Since the spring 40 acts against such movement of the valve needle 20, movement of the valve needle 20 away from the seating 18 only occurs once a sufficiently high pressure exists within the bore 12 and annular chamber 16. Once such a pressure has been reached, the valve needle 20 is lifted from the seating 18, movement of the valve needle 20 continuing until the end of the extension rod 54 engages the spherical valve element 46. In such a position, the valve needle 20 is lifted from the seating 18 by only a small amount, thus a restricted flow of fuel is permitted between the valve needle 20 and seating 18. Fuel is thus supplied from the outlet apertures 14 at a relatively low rate. Once the valve needle 20 is lifted from the seating 18, pressurized fuel also acts against any previously obscured part of the thrust surface 20*c*.

As high pressure fuel continues to be supplied to the annular chamber 16 and bore 12, and since fuel is only being delivered at a relatively low rate, the fuel pressure within the bore 12 and annular chamber 16 increases, and a point will be reached at which the pressure acting on the thrust surfaces 20*c*, 20*d* is sufficient to push the valve element 46 against the action of the spring 48 and the force due to the high pressure fluid from the source 52 acting against the spherical valve element 46, such movement of the valve element 46 resulting in the spacing of the valve needle 20 from the seating 18 being increased, thus permitting an increased rate of fuel supply through the outlet apertures 14.

It will be recognised that once the spherical valve element 46 has left its seating, high pressure fluid from the source 52 and valve chamber 42 is permitted to flow through the passage 44 to the spring chamber 38 and acts against the valve needle 20, thus increasing the force tending to move the valve needle 20 towards the seating 18. However whilst high pressure fuel from the source 58 is supplied to the bore 12 and annular chamber 16, the force exerted on the thrust surfaces 20*c*, 20*d* is sufficiently great to maintain the valve needle 20 in a position in which the end region 20*c* is spaced from the seating 18 by a sufficiently large distance that fuel is delivered from the outlet apertures 14 at a relatively high rate.

In order to terminate injection, fuel is no longer supplied from the source 58 to the supply passage 56, and indeed the supply passage 56 may be connected to a volume of relatively low pressure so that the pressure of fuel within the supply passage 56, bore 12, and annular chamber 16 is reduced. The termination of supply of fuel to the bore 12 and annular chamber 16 results in the pressure acting against the thrust surfaces 20*c*, 20*d* falling, and a point will be reached at which the pressure applied to the thrust surfaces 20*c*, 20*d* is insufficient to maintain the valve needle 20 in the position spaced from the seating 18 against the action of the spring 40 and the relatively high pressure fluid acting against the valve needle 20. Under these circumstances, the valve needle 20 will return to the position illustrated in FIG. 1 but prior to this the spherical valve element 46 will return to the illustrated position in which it engages its seating thus terminating the supply of high pressure fluid to the spring chamber 38. The pressure of the fluid within the spring chamber 38 will continue to assist the closing movement of the valve needle but will fall due to the connection of the drain passage 30 and connecting passage 32 therewith. At the start of the next injection the pressure in the spring chamber 38 will be substantially drain pressure.

As, in use, high pressure fluid acts against the valve needle 20 assisting the spring 40, termination of injection will occur at a point when the fuel pressure in the bore 12 is higher than would be the case if the valve needle 20 moved towards the seating 1 8 under the influence of the spring 40 alone. This is advantageous in that engine efficiency is improved.

It will be recognised that rather than a spherical valve element 46, a variety of other shaped valve elements could be used, and further it will be understood that in some circumstances the provision of the spring 48 will not be necessary, the pressure of the fluid from the high pressure source 52 being sufficient to ensure that the valve element returns to its position in which it engages the seating. In further alternatives, the extension rod 54 may be integral with the valve element 46 or may be a separate element from both the spring abutment 28 and the valve element 46.

Figure 2:
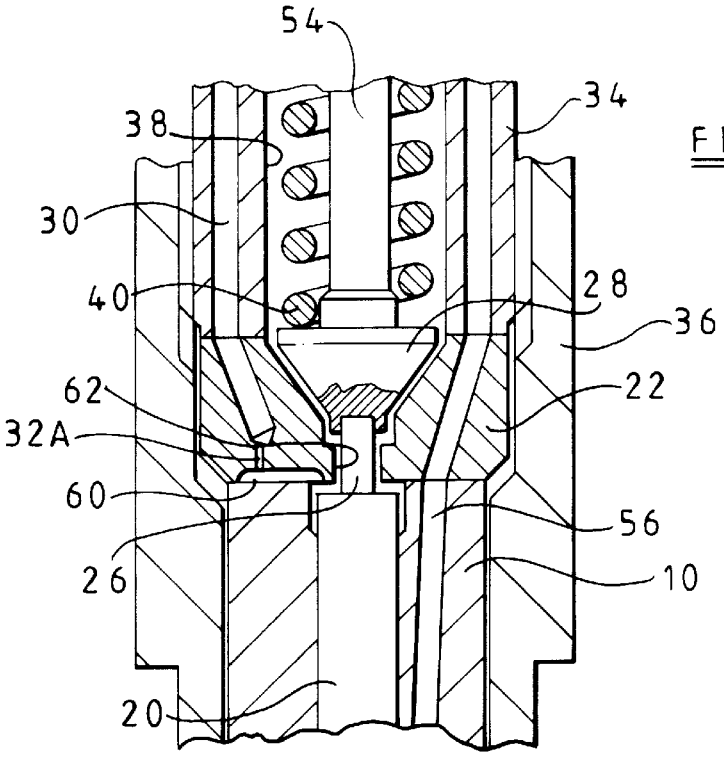
FIG. 2 is a cross-sectional view of part of a modification to the embodiment of FIG. 1.

The modification illustrated in FIG. 2 is similar to that illustrated in FIG. 1 and like parts are denoted by like reference numerals. In the modification, the connecting passage 32 is omitted, and instead the drain passage 30 is connected through a restricted passage 32A with a recess 60 provided in the end face of the distance piece 22 which abuts the nozzle body 10. The recess 60 communicates with the bore 12 and is arranged to communicate with the spring chamber 38 through a passage 62 provided in the distance piece 22, the passage 62 forming part of the through bore 24. In use of the injector, when the valve needle 20 moves to its fully open position, an end face thereof abuts the distance piece 22 thus closing the passage 62 and preventing high pressure fluid from the source 52 escaping to the recess 60 and from there to the drain passage 30. It will be recognised that this arrangement reduces the quantity of high pressure fluid which is supplied by the high pressure fluid source 52 during each cycle of operation of the injector.

As in the embodiment illustrated in FIG. 1, on termination of injection the valve needle 20 moves into engagement with the seating 18 whilst the pressure of fuel within the bore 12 is higher than would be the case if the valve needle 20 were returned only under the action of the spring 40. Whilst the valve needle 20 is in its fully open position, only a relatively small effective area of the valve needle 20 is exposed to the high pressure fluid. However, once movement of the valve needle 20 commences the effective area of the valve needle 20 exposed to high pressure fluid increases as the end of the valve needle 20 no longer closes the passage 62.

Figure 3:
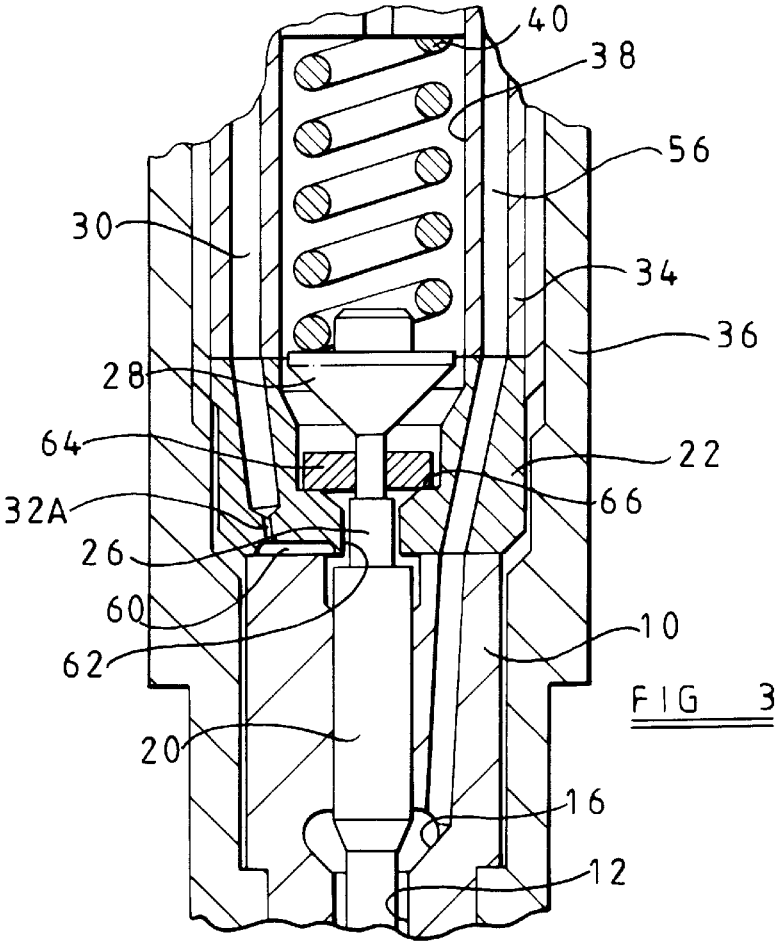
FIG. 3 is a cross-sectional view of part of an injector constituting a second embodiment.

The embodiment illustrated in FIG. 3 is similar to that illustrated in FIG. 2 and like reference numerals are used to denote like parts. In the embodiment of FIG. 3, the valve chamber 42 and spherical valve element 46 are omitted together with the extension rod 54. It will be recognised therefore that high pressure fluid from the source 52 is supplied at all times to the spring chamber 38.

A valve plate 64 is slidable upon a relatively narrow region of the extension 26 to the valve needle 20, the extension 26 and valve plate 64 forming a substantially fluid tight seal with one another. The bore 24 in the distance piece 22 is shaped so as to include a stepped region which defines a valve seating 66 with which the valve plate 64 is engageable. As in the modification illustrated in FIG. 2, the bore 24 includes a passage 62 providing a fluid path through the distance piece 22 to the bore 12, the distance piece 22 including a recess 60 arranged to communicate with the drain passage 30.

In use, on applying high pressure fuel to the supply line 56, the valve needle 20 is lifted against the action of the spring 40 until a position is reached in which the relatively large part of the extension 26 engages the lower surface of the valve plate 64. At this point, the end region 20*c* of the valve needle 20 is spaced from the seating 18 by a small amount thus permitting a relatively low rate of fuel delivery from the outlet apertures 14.

As in the previously described embodiment, the fuel pressure within the annular chamber 16 and bore 12 increases due to the continued application of high pressure fuel from the source 58 whilst only a relatively low rate of fuel delivery is occurring, and a point will be reached at which the pressure applied to the thrust surfaces 20*c*, 20*d* of the valve needle 20 is sufficient to lift the valve plate 64 from its seating 66. The lifting of the valve plate 64 permits the valve needle 20 to be lifted from its seating 18 by an increased amount whereby the rate of fuel delivery from the outlet apertures 14 is increased.

As in the modification illustrated in FIG. 2, the increased movement of the valve needle 20 results in the valve needle 20 engaging the lower surface of the distance piece 22 thus closing the passage 62 resulting in a reduction in the quantity of high pressure fluid escaping from the spring chamber 38 to the drain passage 30 and a reduction in the end area of the valve needle exposed to the fluid pressure.

In order to terminate injection, the supply of fuel from the source 58 is terminated whereby a reduction of the fuel pressure in the bore 12 and annular chamber 16 takes place. The reduction in pressure will result subsequently in a point being reached at which the force acting on the valve needle 20 due to the spring 40 and due to the high pressure fluid is sufficient to move the valve needle 20 towards the seating 18. Before the valve needle engages the seating 18, the valve plate 64 engages the seating 66 and the supply of high pressure fluid to the space on the needle side of the valve plate is cut off. The pressure in this space although decaying through the restricted passage 32A, continues to assist closure of the valve needle onto the seating 18.

In the embodiment of FIG. 3, it may be advantageous to increase the volume of the space defined between the valve seating 66 and the upper end of the valve needle 20, for example by connecting it to a subsidiary volume, as such an increase in volume means that the pressure will decrease more slowly and the pressure decrease due to the movement of the valve element towards the seating will be reduced. Thus more assistance will be provided for the last part of the movement of the valve needle 20 into engagement with the seating 18.

As with the previously described embodiments, an advantage of this injector is that the valve needle 20 moves into engagement with the seating 18 both under the action of the spring 40 and due to the application of high pressure fluid to the valve needle 20, resulting in the valve needle 20 moving into engagement with the seating 18 at an earlier time than would occur if the valve needle were moveable only under the influence of the spring 40. Such an increased rate of termination of injection improves engine efficiency as the final part of injection is at a greater rate than would otherwise occur.

A further advantage of each of the described injectors is that as the fluid is derived from a source separate from that supplying high pressure fuel to the injector, the pressure of the fluid can be controlled independently of fuel pressure. The injector is therefore of increased controllability. In each case, the high pressure fluid from the source 52 could be fuel, or alternatively it may take the form of a different fluid.

I claim:

1. An injector comprising a valve element engageable with an injector seating, the valve element being resiliently biased into engagement with the injector seating, the valve element including a thrust surface arranged, in use, to have high pressure fuel applied thereto to lift the valve element from the injector seating, and stop means arranged to restrict movement of the valve element away from the injector seating, wherein the stop means comprises a second valve member engageable with a valve seating and arranged to have high pressure fluid applied thereto, the second valve member being movable away from the valve seating under the influence of the valve element against the action of the high pressure fluid, in use, the second valve member controlling fluid flow to the valve element along a path independent of a fuel supply path whereby fuel is supplied towards the injector seating.

2. An injector as claimed in claim 1, wherein the high pressure fluid applied to the second valve member is derived from a source separate from a source arranged to supply high pressure fuel to the thrust surface.

3. An injector as claimed in claim 1, wherein, on opening of the second valve member, high pressure fluid is applied to the valve element to assist subsequent movement of the valve element into engagement with the seating.

4. An injector as claimed in claim 1, wherein the second valve member is engageable with a second seating, the second valve member comprising a plate valve member.

5. An injector as claimed in claim 1, wherein the second valve member is engageable with a second seating, the second valve member comprising a spherical valve member.

6. An injector as claimed in claim 5, wherein the second valve member is spring biased into engagement with the second seating.

7. An injector as claimed in claim 1, further comprising a restricted drain passage whereby high pressure fluid which passes the second valve member is removed from the injector.

8. An injector as claimed in claim 7, wherein movement of the valve element to a fully open position closes the restricted drain passage.

* * * * *

UNITED STATES PATENT AND TRADEMARK OFFICE

CERTIFICATE OF CORRECTION

PATENT NO. : 5,826,793

DATED : October 27, 1998

INVENTOR(S) : JAMES M.A. ASKEW

It is certified that error appears in the above-indentified patent and that said Letters Patent is hereby corrected as shown below:

On the title page, add the Foreign Application Priority Data:
Great Britain [GB], 9525369.6 12-12-95.

Signed and Sealed this

Sixteenth Day of March, 1999

*Attest:*

Q. TODD DICKINSON

*Attesting Officer*

*Acting Commissioner of Patents and Trademarks*